US009659501B2

(12) United States Patent
Lee

(10) Patent No.: US 9,659,501 B2
(45) Date of Patent: May 23, 2017

(54) VESSEL MONITORING SYSTEM AND VESSEL MONITORING METHOD THEREOF

(71) Applicant: ELECTRONICS AND TELECOMMUNICATIONS RESEARCH INSTITUTE, Daejeon (KR)

(72) Inventor: Byung-Gil Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/004,389

(22) Filed: Jan. 22, 2016

(65) Prior Publication Data

US 2016/0217692 A1 Jul. 28, 2016

(30) Foreign Application Priority Data

Jan. 22, 2015 (KR) ..... 10-2015-0010591

(51) Int. Cl.
*G08G 3/02* (2006.01)

(52) U.S. Cl.
CPC ..... *G08G 3/02* (2013.01)

(58) Field of Classification Search
CPC ..... G08G 3/02
See application file for complete search history.

(56) References Cited

U.S. PATENT DOCUMENTS 6,249,241 B1 * 6/2001 Jordan ..... G01S 7/003 342/41
6,933,884 B2 * 8/2005 Martin ..... B63B 49/00 342/357.55
7,047,114 B1 * 5/2006 Rogers ..... G08G 3/02 340/438
7,768,443 B2 * 8/2010 Imazu ..... B63B 43/18 340/984
7,889,232 B2 * 2/2011 Chew ..... G01S 3/7865 348/143
8,612,129 B2 * 12/2013 Gagliardi ..... G08G 3/02 342/41

(Continued)

FOREIGN PATENT DOCUMENTS

KR 10-2006-0024582 A 3/2006
KR 10-2011-0098465 A 9/2011

(Continued)

OTHER PUBLICATIONS

Won-Sun Baek, et al., "Analysis on the navigational dangerous elements in jindo coastal VTS area to improve marine traffic system", 2007 Journal of the Korean Society of Marine Environment & Safety, pp. 175-176.

*Primary Examiner* — Thomas Tarcza
*Assistant Examiner* — Alex C Dunn

(57) ABSTRACT

Provided is a vessel monitoring method of a vessel monitoring system, which includes receiving first vessel information from an automatic identification system message output from a vessel, receiving second vessel information on the vessel from a port management information system, selecting a vessel tracking parameter on a basis of the first vessel information and the second vessel information, and tracking the vessel by using a tacking algorithm corresponding to the vessel tracking parameter.

13 Claims, 6 Drawing Sheets

(56) References Cited

U.S. PATENT DOCUMENTS

| | | | | |
|---|---|---|---|---|
| 2009/0167592 | A1* | 7/2009 | Kao | G01S 7/021 342/41 |
| 2010/0070118 | A1* | 3/2010 | Yamada | B63B 21/00 701/21 |
| 2011/0210865 | A1 | 9/2011 | Lee et al. | |
| 2012/0271538 | A1 | 10/2012 | Lee et al. | |
| 2012/0316769 | A1* | 12/2012 | Gagliardi | G08G 3/02 701/300 |
| 2014/0022107 | A1* | 1/2014 | Kim | G08G 3/00 342/41 |

FOREIGN PATENT DOCUMENTS

| | | | |
|---|---|---|---|
| KR | 10-2013-0052287 | A | 5/2013 |
| KR | 10-2013-0071580 | A | 7/2013 |
| KR | 20140137233 | A * | 12/2014 |

* cited by examiner

FIG. 3

| VESSEL TYPE (USE) CODE | VESSEL TYPE (USE) CODE NAME |
|---|---|
| 11 | PASSENGER SHIP |
| 12 | CARGO SHIP |
| 13 | INTERNATIONAL CAR FERRY |
| 14 | CRUISE SHIP |
| 21 | BULK CARRIER |
| 22 | BULK CARRIER |
| 23 | HARDWOOD CARRIER |
| 24 | ORE CARRIER |
| 25 | COAL CARRIER |
| 26 | CEMENT CARRIER |
| 27 | VEHICLE CARRIER |
| 28 | HOT COIL CARRIER |
| 29 | STEEL ORE CARRIER |
| 30 | PURE COIL CARRIER |
| 31 | SAND CARRIER |
| 32 | REFRIGERATOR SHIP |
| 33 | WASTE CARRIER |
| 39 | CARGO SHIP |
| 41 | FULL CONTAINER SHIP |
| 42 | SEMI CONTAINER SHIP |
| 51 | CRUDE OIL TANKER |
| 52 | OIL PRODUCT CARRIER |
| 53 | OIL PRODUCT CARRIER |
| 54 | CHEMICAL GAS CARRIER |
| 55 | LPG CARRIER |
| 56 | LNG CARRIER |
| 59 | OTHER TANKERS |
| 61 | TOWING TUG |
| 62 | QUAY TUG |
| 63 | HARBOR TUG |
| 69 | OTHER TUG BOATS |

| VESSEL TYPE (USE) CODE | VESSEL TYPE (USE) CODE NAME |
|---|---|
| 70 | TUG-BARGE |
| 71 | SAND CARRYING BARGE |
| 72 | STEEL ORE CARRYING BARGE |
| 73 | CRUDE OIL CARRYING BARGE |
| 74 | OIL PRODUCTS CARRYING BARGE |
| 75 | CHEMICAL CARRYING BARGE |
| 76 | CARGO CARRYING BARGE |
| 77 | CONSTRUCTION BARGE |
| 78 | NEW SHIPBUILDING |
| 79 | OTHER BARGES |
| 81 | PUBLIC SHIP |
| 82 | POLICE SHIP |
| 83 | WAR SHIP |
| 89 | MARINE LEISURE CRAFT |
| 91 | COASTAL/INSHORE FISHING BOAT |
| 92 | DEEP-SEA FISHING VESSEL |
| 93 | TANKER |
| 94 | WATER BOAT |
| 95 | DELIVERY SHIP (FERRY BOAT) |
| 96 | DREDGER |
| 97 | CRUISE SHIP |
| 98 | PILOT BOAT |
| 99 | OTHERS |

FIG. 4

| VESSEL TYPE | BREADTH (B) OF VESSEL | LENGTH (L) OF VESSEL | TRACKING PERFORMANCE | TURNING PERFORMANCE | | STOP PERFORMANCE | | HIGH SPEED PERFORMANCE | | TOTAL COLLISION/ AVOIDANCE PERFORMANCE | |
|---|---|---|---|---|---|---|---|---|---|---|---|
| | UNIT m | UNIT m | | L GENERALIZATION | ACTUAL DISTANCE m | L GENERALIZATION | ACTUAL DISTANCE m | L GENERALIZATION | ACTUAL DISTANCE m | | |
| WIG SHIP(27) | | | | | | | | | | | |
| FISHING BOAR(30) | | | | | | | | | | | |
| TUGBOAT(31) | | | | | | | | | | | |
| TUGBOAT(32) | | | | | | | | | | | |
| DREDGER(33) | | | | | | | | | | | |
| DIVER BOAT(34) | | | | | | | | | | | |
| WAR SHIP(35) | | | | | | | | | | | |
| SAIL BOAT(36) | | | | | | | | | | | |
| CRUISE SHIP(37) | | | | | | | | | | | |
| HIGH SPEED VESSEL(45) | | | | | | | | | | | |
| PILOT BOAT(50) | | | | | | | | | | | |
| RESCUE SHIP(51) | | | | | | | | | | | |
| TUGBOAT(52) | | | | | | | | | | | |
| BARGE(53) | | | | | | | | | | | |
| PASSENGER SHIP(6?) | | | | | | | | | | | |
| CARGO SHIP(7?) | | | | | | | | | | | |
| OIL TANKER(8?) | | | | | | | | | | | |
| ⊙ | | | | | | | | | | | |
| ⊙ | | | | | | | | | | | |
| ⊙ | | | | | | | | | | | |

VESSEL MONITORING SYSTEM AND VESSEL MONITORING METHOD THEREOF

CROSS-REFERENCE TO RELATED APPLICATION

This U.S. non-provisional patent application claims priority under 35 U.S.C. §119 of Korean Patent Application No. 10-2015-0010591, filed on Jan. 22, 2015, the entire contents of which are hereby incorporated by a reference.

BACKGROUND

The present disclosure herein relates to a vessel monitoring system and a vessel monitoring method thereof which tracks a vessel in order to reduce a danger of accident such as collision which may occur in navigation, and performs decision making on the danger.

A vessel traffic service (VTS) protects a human life on the sea, vessel safety, and marine environment by monitoring nautical safety and law-abidingness of a vessel in navigation in an area, such as a port or coastal area where ship traffic is congested or shipping condition is bad, and if necessary, by guiding navigation of the vessel and preventing ship safety accident in advance through providing navigation safety information. In addition, a port management information system (PortMIS) is a system for improving efficiency in port management through promotion of ship navigation efficiency and for managing vessel information related to shipping and logistics such as management of vessel entering and clearing.

SUMMARY

The present disclosure provides a safer vessel monitoring system and a vessel monitoring method thereof.

An embodiment of the inventive concept provides a vessel monitoring method of a vessel monitoring system. The vessel monitoring method includes: receiving first vessel information from an automatic identification system (AIS) message output from a vessel; receiving second vessel information on the vessel from a port management information system (PortMIS); selecting a vessel tracking parameter on a basis of the first vessel information and the second vessel information; and tracking the vessel by using a tacking algorithm corresponding to the vessel tracking parameter.

In an embodiment, the first vessel information may include identification information, static information, or dynamic information.

In an embodiment, the second vessel information may include vessel type information, vessel data, steering characteristic information, or steering performance information.

In an embodiment, the tracking algorithm may be differed according to the vessel type information.

In an embodiment, the tracking of the vessel may include: receiving a radar signal corresponding to position information on the vessel from a radar; and tracking the vessel by using the radar signal and the tracking algorithm, and may further include calculating a position and a speed of the vessel by considering the first vessel information and the second vessel information, and the position information in a multi-sensor fusing processor.

In an embodiment, the vessel monitoring method may further include displaying a movement of the vessel on a monitoring display device according to the position and speed of the vessel.

In an embodiment, the vessel monitoring method may further include calculating a degree of collision danger with another vessel according to the calculated position and speed of the vessel, wherein the degree of collision danger with the other vessel is differently calculated according to the vessel type information.

In an embodiment, the vessel monitoring method may further include displaying the calculated degree of collision danger on the monitoring display device.

In an embodiment, the vessel monitoring method may further include additionally displaying steering characteristic information on the vessel, a tidal current situation, and a sea water situation on the monitoring display device on a dangerous situation.

In an embodiment, when the vessel is a tug-barge, the vessel has not an individual type but a connected type, and the tracking algorithm is applied to the connected type vessel.

In an embodiment, when the vessel is a tug-barge, a tug-boat and a barge may be recognized but a degree of collision danger between the tug-boat and barge is not calculated.

In an embodiment, the vessel monitoring method may further include monitoring the path through a tracking algorithm to which the steering characteristic for each vessel is applied, when it is determined from the first vessel information and the second vessel information that the vessel navigates alongside an identical pier or navigates an identical path in a predetermined area.

In an embodiments of the inventive concept, a vessel monitoring system includes: an AIS message analyzer configured to receive an AIS message from a vessel and generate first vessel information; a port information linking system configured to read and store second vessel information on the vessel from a PortIMS; a vessel information database system configured to receive the first vessel information and the second vessel information, and to generate a vessel tracking parameter on the vessel; a vessel tracking processor configured to request the vessel tracking parameter on the vessel from the vessel information database system, and to track the vessel according to a tracking algorithm corresponding to the vessel tracking parameter by using the AIS message or a radar signal for providing position information on the vessel; a multi-sensor fusing processor configured to calculate a position and a speed of the vessel by using the first vessel information and second vessel information, or the position information; a decision making supporting processor configured to calculate a degree of collision danger with another vessel by using the position and speed of the vessel calculated from the multi-sensor fusing processor; and a monitoring display device configured to display a movement of the vessel and the degree of collision danger on a basis of the position and speed of the vessel.

In an embodiment, the monitoring display device may display the position information on the vessel and characteristic information on a current situation by using tracking information from the vessel tracking processor, the position information from the multi-sensor fusing processor, or information received from at least one of a CCTV, satellite, or UAV.

BRIEF DESCRIPTION OF THE FIGURES

The accompanying drawings are included to provide a further understanding of the inventive concept, and are incorporated in and constitute a part of this specification.

The drawings illustrate exemplary embodiments of the inventive concept and, together with the description, serve to explain principles of the inventive concept. In the drawings:

FIG. 3 illustrates an exemplary code of a subdivided type of vessel;

FIG. 4 illustrates an embodiment of a vessel type classified in a port management information system (PortMIS);

DETAILED DESCRIPTION

Hereinafter, exemplary embodiments will be described in more detail with reference to the accompanying drawings that are used to help those skilled in the art to easily practice the technical idea of the present invention.

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art.

Hereinafter, exemplary embodiments of the inventive concept will be described in detail with reference to the accompanying drawings.

Figure 1:
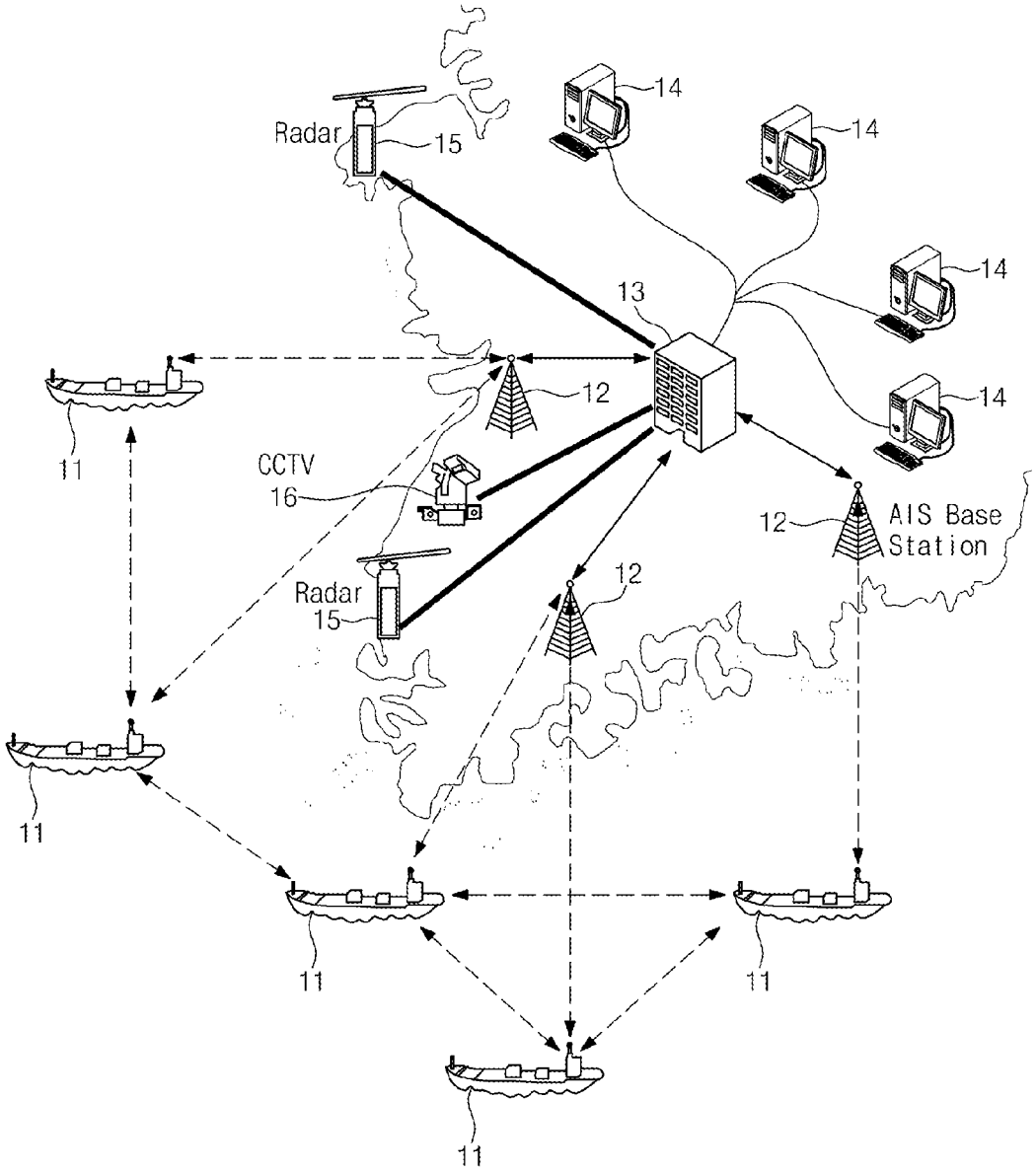
FIG. 1 exemplarily illustrates a general vessel traffic service (VTS) system.

FIG. 1 exemplarily illustrates a general vessel traffic service (VTS) system. As illustrated in FIG. 1, there are a port VTS, a coast VTS, and a VTS system 10 for managing Gyeongin Canal in Korea.

Referring to FIG. 1, a vessel monitoring system 13 may receive an automatic identification system (AIS) message from a vessel 10 through an AIS base station 12, obtain position information on a tag (or vessel) from a radar 15, and grasp marine information through a CCTV 16. In addition, the vessel monitoring system 12 may receive the AIS message, position information, or marine information, and display the received AIS message, position information, or marine information through a monitoring display device 13-4. A controller may control through monitoring the displayed information.

Figure 2:
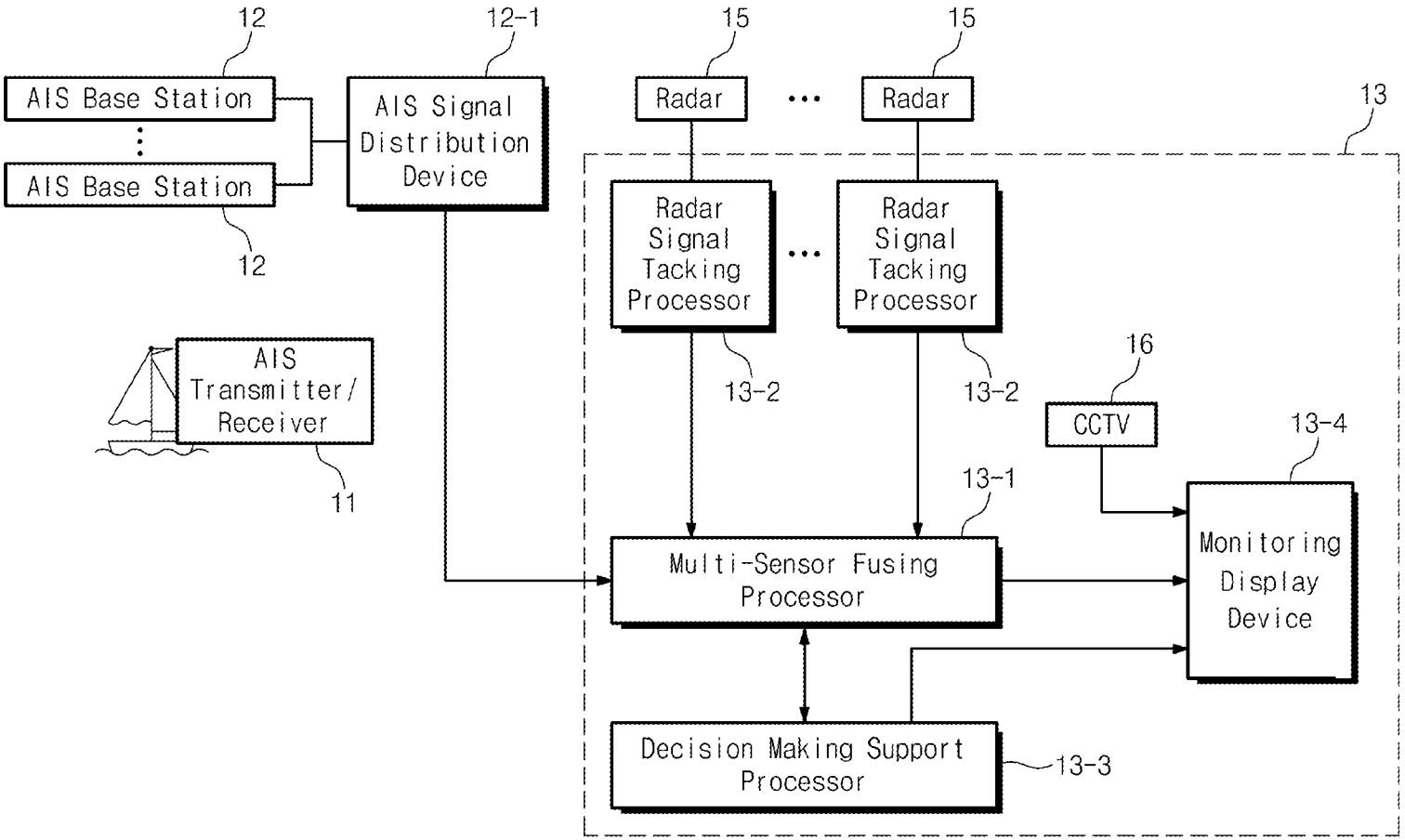
FIG. 2 is an exemplary block diagram illustrating the vessel monitoring system 13 illustrated in FIG. 1.

FIG. 2 is an exemplary block diagram illustrating the vessel monitoring system 13 illustrated in FIG. 1. Referring to FIG. 2, the vessel monitoring system 13 includes a multi-sensor fusing processor 13-1, at least one radar signal vessel tracking processor 13-2, a decision making supporting processor 13-3, and the monitoring display device 13-4.

The multi-sensor fusing processor 13-1 may synthesize information output from an AIS signal distribution device 12-1 or information output to the radar signal vessel tracking processor 13-2, calculate a position and a speed of a vessel, and display the calculated result at a corresponding position on the monitoring display device 13-4. The AIS base station 12 may receive and collect AIS messages transmitted from the vessel 10 with an AIS transmitter/receiver 11 embedded therein and transmit the received or collected result to the multi-sensor fusing processor 13-1 that requires an AIS through the AIS signal distribution device 12-1, or if necessary, transmit to the radar signal vessel tracking processor 13-2.

The radar signal vessel tracking processor 13-2 removes noise of position information of the vessel from the radar 15 and generates a track of the vessel. This position information is transmitted to the multi-sensor fusing processor 13-1.

The decision making supporting processor 13-3 may receive a fused result value of the multi-sensor fusing processor 13-1, calculate a degree of danger of ship-to-ship collision, and display the calculation result on the monitoring display device 13-4. Here, the monitoring display device 13-4 displays a vessel movement type on a corresponding map such as an electronic navigational chart. A controller may check this and predict to control a dangerous situation or the like.

Typically, the vessel monitoring system 13 mainly depends on experience of the controller in vessel management by a detailed individual process according to characteristics of each vessel. In addition, recently the type of vessel becomes diversified, and the speed or characteristics of the vessel become improved. In particular, recently, together with an ultra high speed ship (maximum 130 knots) such as a WIG ship, a luxury cruise ship, an oil tanker, and a dangerous cargo ship such as a tug-barge are increased. Accordingly, despite of various types of vessels, an identical vessel tracking algorithm, identical calculation of a degree of danger, identical sensor fusing, and identical path management cause a result that a monitoring target is not analyzed in real time.

On the other hand, a vessel monitoring system according to an embodiment of the inventive concept may apply an adaptive scheme in which detailed characteristics of a vessel are reflected to a monitoring processor to allow a high speed ship to perform high speed processing, allow a small ship such as a fishing boat to employ a signal processing and tracking algorithm that is proper to the small ship, and allow a tug-barge including a tugboat and barge to process in a correspondingly connected type to calculate the degree of danger. In other words, in a case of calculating the degree of danger of the vessel, the degree of danger may be calculated according to steering parameters such as rotational characteristics of stopping and veering of the vessel. Accordingly, a vessel monitoring system according to an embodiment of the inventive concept may suggest a solution on a vessel accident through detailed monitoring and management by a controller in the decision making support system.

A vessel monitoring system of an embodiment according to an embodiment of the inventive concept may predict a path of a vessel in navigation and estimate a degree of danger of mutual collision to prevent an accident in a dangerous situation, which may occur in a corresponding path. In detail, an accurate prediction on a movement direction of the vessel, which is displayed on a monitoring screen, is performed by the vessel monitoring system, and the vessel monitoring system calculates information on the position of the vessel from the radar and AIS. The vessel monitoring system calculates a predicted direction and speed of the vessel from an estimation and prediction algorithm such as Kalman filter, calculates a final speed and longitudinal and latitudinal position information by reflecting values actually measured by the radar or AIS to improve an error, and generates integrated longitudinal and latitudinal position, speed, and direction information by fusing sensor signals when the sensor signals are received from several installed radars and AIS equipments.

The AIS is a device for broadcasting information such as a position, speed, or course of the vessel in a predetermined time interval without intervention of a man, and a device for performing functions of preventing ship-to-ship collision, notifying the vessel's position, and monitoring situation of ship navigation. The AIS corresponds to a communication device for providing, in real time, navigation information such as the position, speed, or course of the vessel, and classifies the navigation information into identification information, static information, and dynamic information to transmit the information. The vessel information defined in the AIS includes simple, and not subdivided, information such as a type of the ship.

In addition, the vessel information in the PortMIS includes more detailed vessel classification information and characteristics thereof. According to this detailed vessel type, the steering characteristic information on the vessel is more subdivided and a vessel information database may be constructed according to characteristics thereof. Basically, basic vessel information capable of being used in monitoring may be extracted from the PortMIS as shown in the following Table 1.

TABLE 1

| Ship information field | Field description |
|---|---|
| MMSI | ship MMSI |
| Ship Type | ship type |
| Callsign | call sign |
| GrossTons | gross number of tons |
| AgentCode | code of Agent |
| CountryCode | code of nationality of ship |
| ShipDraught | number of draughts |
| IMONo | IMO number |
| InternationalTons | total number of international tons |
| KorShipName | ship name in Korean |
| NetTons | net number of tons |
| ShipWidth | ship width |
| ShipDepth | ship depth |
| ShipLength | ship length |
| DeadWeight | DEAD_WEIGHT |
| ShipOperatorCountryCode | code of nationality of ship operation |
| ShipOperatorID | ID of ship operator |
| ShipOwnerCountryCode | code of nationality of ship owner |
| ShipOwner | code of ship owner |
| ShipPhone | phone number of ship |

FIG. 3 illustrates an exemplary code of a subdivided type of vessel. Referring to FIG. 3, the code corresponding to a vessel type may be subdivided to be classified according to use. Although different tracking algorithms may not be applied to different vessels according to the vessel type, since a fishing ship, passenger ship, container ship, and the like have large difference in characteristic, different tracking algorithms are required to be applied.

FIG. 4 illustrates an embodiment of a vessel type classified in a PortMIS. Referring to FIG. 4, the vessel type are classified by the PortMIS according to ship width B, ship length L, tracking performance, turning performance, stop performance, high speed performance, composite collision/avoidance performance, or the like.

As illustrated in FIG. 4, the vessel monitoring system may re-classify and arrange characteristics of a vessel according to tracking performance of the vessel in consideration of similar performance in the information classified in detail.

The following is exemplary data of 50-seat WIG ship. The size of hull (full length/width/height): about 28.5 m/about 26.9 m/about 6.7 m, material: aluminum, speed: about 120~ about 180 km/h in flight, about 10 km/h in sea-level navigation. On the other hand, data of 5-seat WIG ship is as the following. The size of hull (full length/width/height): about 10 m/about 12 m/about 2.9 m, material: FRP, speed: about 130~ about 240 km/h in flight, about 10 km/h in sea-level navigation. From a view of the foregoing data of the currently developed WIG ships, a corresponding speed is greatly different from that of the existing ship, and from a view of the existing ship, a danger of accident may be more increased. In addition, when a single Kalman filter, which is an identical tracking algorithm, is used, the existing tracking algorithm makes it difficult to track the WIG ship due to the fast speed thereof. Accordingly, it is necessary to use multiple Kalman filters in tracking.

In addition, from the foregoing vessel classification and performance classification, the tracking algorithm may calculate a degree of collision danger in order to process a composite dangerous situation by considering maneuver performance.

A tracking algorithm according to an embodiment of the inventive concept may apply an adaptive method, in which detailed characteristics of a vessel are reflected, to a monitoring ship tracking processor. For example, the degree of danger may be calculated by performing a high speed process by a high speed vessel, performing signal processing and tracking proper to the small ship by a small ship such as a fishing boat, and processing in a connected type by a tug-barge including a tugboat and barge. In other words, the tracking algorithm according to an embodiment of the inventive concept may manage to safely navigate by managing the danger through calculating the degree of danger according to steering parameters such as rotational characteristic of stopping and veering of the vessel. As the result, a monitoring center may provide a service for rapidly displaying, if necessary, and safely and rapidly monitoring and controlling corresponding characteristic information.

Figure 5:
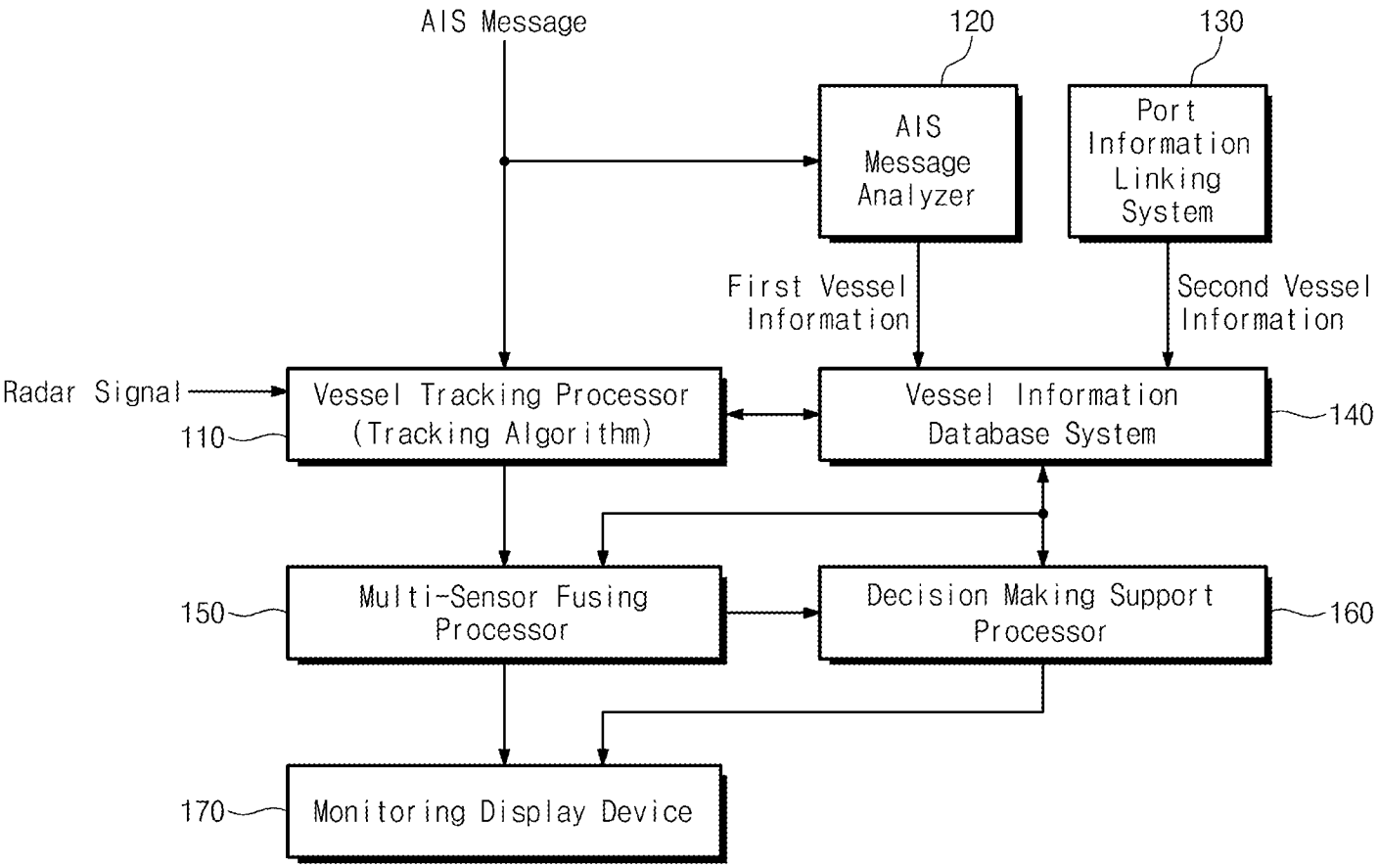
FIG. 5 is a block diagram of an exemplary vessel monitoring system according to an embodiment of the inventive concept.

FIG. 5 is a block diagram of an exemplary vessel monitoring system 100 according to an embodiment of the inventive concept. Referring FIG. 5, the vessel monitoring system 100 includes a vessel tracking processor 100, an AIS message analyzer 120, a port information linking system 130, a vessel information database system 140, a multi-sensor fusing processor 150, a decision making supporting processor 160, and a monitoring display device 170.

The vessel tracking processor 110 performs an AIS-based automatic tracking to track a vessel 10 (for example). The vessel tracking processor 110 requests vessel tracking parameters from the monitoring display device 170 on the basis of vessel classification information of the AIS message, and performs verification on the AIS message of a corresponding vessel by using a maritime mobile service identity (MMSI) identifier. The vessel tracking processor 110 may track and monitor the vessel according to a tracking algorithm corresponding to vessel tracking parameters. Accordingly, the vessel monitoring system 100 may differently process the tracking for each vessel.

In addition, the vessel tracking processor 110 may receive position information on the vessel from a radar, remove noise, and generate a vessel's track.

In addition, the vessel tracking processor 110 may receive marine information from a CCTV (not illustrated), and if necessary, process and fabricate the marine information.

The AIS message analyzer 120 analyzes an AIS message output from an AIS signal distributor 12-1. The AIS message may include an MMSI, vessel's dynamic information, or vessel's static information. Hereinafter, this AIS message is named "first vessel information".

The port information linking system 130 stores "second vessel information" registered in the PortMIS. The second vessel information may include, as illustrated in FIG. 4, various pieces of information related to vessel's performance.

The vessel information database system 140 stores the first vessel information and the second vessel information. The vessel information database system 140 may generate and store vessel tracking parameters on the basis of the first vessel information and the second vessel information. The vessel information database system 140 may store a plurality of vessel tracking parameters. The vessel information database system 140 may select vessel tracking parameters proper to navigation characteristics of a corresponding vessel to output the selected parameters to the vessel tracking processor 110, in response to a request for the vessel tracking parameters from the vessel tracking processor 110.

The multi-sensor fusing processor 150 may check the vessel information, determine whether a vessel requires a different fusing process according to a vessel type such as a tug-barge (a type where a tugboat and barge moves together at all times: a corresponding ship processes an ID in a different type from an existing ship) in a fusing process, and process accordingly.

When there is an area of danger of accident, such as collision, the decision making supporting processor 160 may calculate a degree of danger including performance information for each vessel (e.g. the second vessel information). In other words, at the time of calculating a degree of danger for each vessel, information on navigation performance of a corresponding vessel will be considered. Since a vessel periodically moves along a certain path, path monitoring may be performed by considering information on navigation performance. In the path monitoring, when abnormality occurs, or path deviation, rapid veering, or the like is monitored, the vessel monitoring system 100 may be informed. In other words, the decision making supporting processor 160 may collect information on danger of accident, which is monitored for each vessel, to transmit the collected result to the monitoring display device 170, and display the received information together with information on vessel characteristic to allow a controller to know about the scene.

Accordingly, the decision making supporting processor 160 may combine intention information on pseudo dangerous situation and reflect a steering characteristic of a corresponding vessel to suggest in which direction a vessel may move in order to avoid collision. Support information may be suggested together in order for the controller to make decision.

The monitoring control device 170 may display the movement of the vessel and the degree of collision danger on the basis of a position and speed of a corresponding vessel. In an embodiment, the monitoring display device 170 may display position information of the corresponding vessel and vessel characteristic information on a current situation by using the first vessel information and the second vessel information, position information, or information received from at least one of a CCTV, satellite, or unmanned aerial vehicle (UAV). For example, as detailed information on a vessel, the vessel characteristic information may include various pieces of information including a type of vessel related to the current situation.

For continuous determination, the monitoring system may continuously calculate the degree of danger by using steering characteristic and data (e.g. length, speed) of the vessel and adding a direction in which the vessel moves, and may differently display the information according to the degree of danger. When the dangerous situation is determined, the controller guides a direction for easily avoiding collision by using the steering characteristic of the vessel, tidal current situation, or sea water situation. In other words, the controller grasps this dangerous limitation in real time and rapidly communicates with the vessel to detect content of accident risk in a corresponding area in order to solve the limitation.

The controller may notify the vessel of a safe navigation direction, speed, or the like in various methods such as voice, or voice and data by considering characteristics, such as vessel steering characteristic information, of a corresponding vessel.

The controller controls by continuously checking whether the dangerous situation is solved in a corresponding direction. The inventive concept providing the foregoing structural characteristic and method may provide a measure capable of performing a control to which an individual algorithm is automatically applied by a system according to a type of vessel and a characteristic of each vessel type, of being used for the control by directly displaying corresponding information on a control screen, and of handling by directly notifying the controller of the result.

Figure 6:
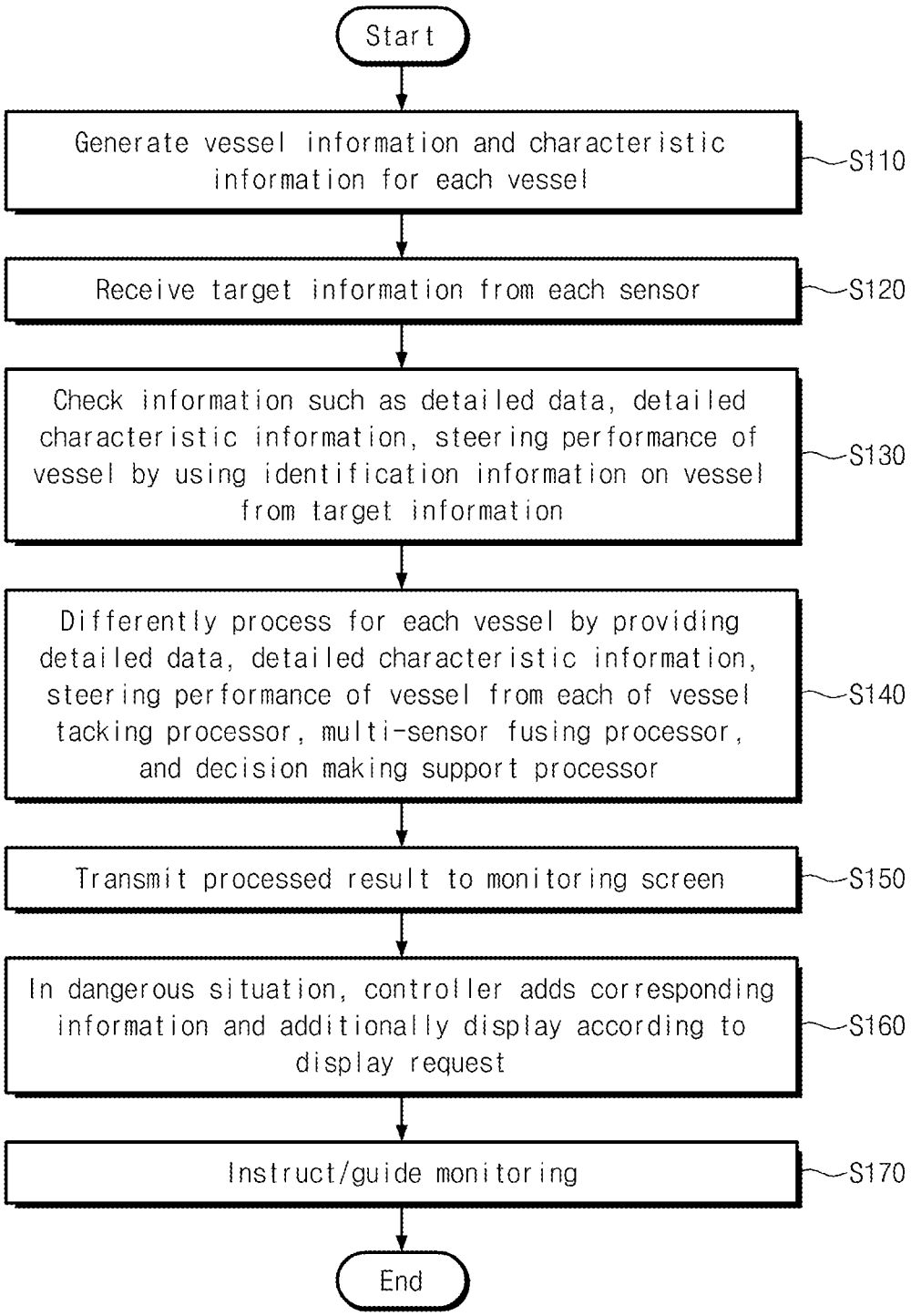
FIG. 6 is an exemplary flowchart of a vessel monitoring method of a vessel monitoring system according to an embodiment of the inventive concept.

FIG. 6 is an exemplary flowchart of a vessel monitoring method of a vessel monitoring system according to an embodiment of the inventive concept. Referring to FIGS. 5 and 6, a vehicle monitoring method of the vehicle monitoring system 100 is as the following.

Vessel information (or first vessel information) and characteristic information of each vessel (second vessel information) are generated (operation S110). Here, the vessel information may be generated from the AIS message analyzer 120 for analyzing an AIS message. Here, the characteristics for each vessel may be generated from the port information linking system 130. Target information (vessel information) may be received from each sensor (operation S120). From the target information, characteristic information for each vessel such as detailed data of a vessel, detailed characteristic information, steering performance, or the like are checked by using identifier information on the vessel (operation S130). Each of the vessel tracking processor 110, multi-sensor fusing processor 150, and decision making supporting processor 160 may process differently according to the characteristic information on each vessel such as detailed data, detailed characteristic information, steering performance, or the like (operation S140). The processed value is transmitted to the monitoring screen (operation S150). In the dangerous situation, the controller adds corresponding information and additionally displays it according to a display request (operation S160). The controller views the monitoring screen and instructs to guide the vessel monitoring (operation S170).

A vessel tracking method according to an embodiment of the inventive concept may be used for all monitoring processors capable of reflecting detailed information of characteristic information on a vessel, such as a passenger ship, in selecting a monitoring algorithm, capable of reflecting in an algorithm for calculating a degree of danger in a dangerous situation, capable of allowing abnormal dangerous information (overload, ballast water, or steering characteristic information such as reconstruction) on the vessel to be displayed on the monitoring screen in order to prevent confusion of danger, capable of lowering the degree of danger by enabling detailed vessel navigation track to be monitored for the vessel that path monitoring is possible, capable of securing stability, and capable of stably processing the monitoring result.

The vessel monitoring system according to an embodiment of the inventive concept may adaptively monitor a vessel by constructing a database, from which a type of navigator, and navigation and steering characteristics according to the type of navigator are grasped, and by providing an algorithm differed by characteristic information on a corresponding vessel type and a processor therefor in a monitoring processor of each navigator.

In an embodiment, the vessel monitoring system applies an adaptive method, in which detailed characteristics of a vessel is reflected, to a tracking processor in order to allow a high speed vessel to perform high speed processing and allow a small ship such as a fishing boat to apply a tracking algorithm proper thereto and differently process.

In an embodiment, when the grasped detailed characteristic information on vessel is related to a tug-barge including a tub-boat and barge, since the vessel is not individual but is a connected type, a tracking process may be differently applied.

In an embodiment, when the grasped detailed characteristic information on vessel is related to a tug-barge including a tub-boat and barge, since the vessel is not individual but is a connected type, a method for fusing and identifying multi-sensor processing results may become differed.

In an embodiment, when the grasped detailed characteristic information on vessel is related to a tug-barge including a tub-boat and barge, since the vessel is not individual but is a connected type, monitoring facilitation may be provided by differently marking a processing result of the perceived vessel from an existing vessel.

In an embodiment, at the time of identifying a corresponding vessel from vessel analysis information, when the grasped detailed characteristic information on vessel is related to a tug-barge including a tub-boat and barge, unlike the existing vessel, monitoring facilitation is provided by allowing characteristic information to be automatically displayed on the monitoring screen.

In an embodiment, at the time of identifying a corresponding vessel from vessel analysis information, when the grasped detailed characteristic information on vessel is related to a tug-barge including a tub-boat and barge, monitoring facilitation may be provided by allowing the tugboat and barge to be recognized and by allowing a mutual degree of danger between the two boats not to be calculated.

A vessel monitoring system according to the inventive concept may monitor a vessel for safe navigation by differently calculating a degree of danger in a dangerous situation for each vessel from steering characteristic parameter information such as stop characteristic and veering characteristic (i.e. turning characteristic).

A vessel monitoring system of the inventive concept may differently perform path monitoring through a characteristic-based monitoring process (i.e. determining whether there is abnormality such as deviation, rapid deceleration, veering, or the like) to which a steering characteristic of a corresponding path monitoring algorithm is applied, for a vessel (e.g. oil tanker, cargo ship, or passenger ship) that continuously navigates alongside an identical pier or navigates an identical path in a predetermined area.

The vessel monitoring system and vessel monitoring method thereof according to embodiments of the inventive concept may more safely monitor than the existing system by differently processing vessel-related data in consideration of a type and characteristic of the vessel.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A vessel monitoring method of a vessel monitoring system, the vessel monitoring method comprising:

receiving, from at least one AIS base station of an AIS system, first vessel information from an automatic identification system (AIS) message output from a vessel, the first vessel information including latitude and longitude coordinates detected by a position sensor on the vessel;

receiving second vessel information on the vessel from a port management information system (PortMIS);

receiving a radar location for the vessel from a radar, calculating, by a multi-sensor fusing processor, position and speed data for the vessel from the first vessel information, the second vessel information, and the position information;

determining a predicted path of the vessel based on the calculated position and speed data; and providing the predicted path to a vessel navigation controller by displaying the predicted path on a display screen.

2. The vessel monitoring method of claim 1, wherein the first vessel information comprises identification information, static information, or dynamic information.

3. The vessel monitoring method of claim 1, wherein the second vessel information comprises vessel type information, vessel data, steering characteristic information, or steering performance information.

4. The vessel monitoring method of claim 3, wherein the tracking algorithm varies according to the vessel type information.

5. The vessel monitoring method of claim 1, further comprising:

displaying a movement of the vessel on a monitoring display device according to the position and speed of the vessel.

6. The vessel monitoring method of claim 1, further comprising:

calculating a degree of collision danger with another vessel according to the calculated position and speed of the vessel, wherein the degree of collision danger with the other vessel is calculated according to vessel type information included in the second vessel information.

7. The vessel monitoring method of claim 6, further comprising:

displaying the calculated degree of collision danger on a monitoring display device.

8. The vessel monitoring method of claim 6, further comprising:

additionally displaying steering characteristic information on the vessel, a tidal current situation, and a sea water situation on a monitoring display device at a time of a dangerous situation.

9. The vessel monitoring method of claim 1, wherein when the vessel is a tug-barge, the vessel is classified as a connected type vessel.

10. The vessel monitoring method of claim 9, wherein when the vessel is a tug-barge, a tug-boat and a barge are recognized but a degree of collision danger between the tug-boat and barge is not calculated.

11. The vessel monitoring method of claim 1, further comprising:

monitoring the path through a tracking algorithm to which the steering characteristic for each vessel is applied, when it is determined from the first vessel information and the second vessel information that the vessel navigates alongside an identical pier or navigates an identical path in a predetermined area.

12. A vessel monitoring system comprising:

an Automatic Identification System (AIS) message analyzer configured to receive an AIS message from a vessel and generate first vessel information;

a port information linking system configured to read and store second vessel information on the vessel from a PortMIS;

a vessel information database system configured to receive the first vessel information and the second vessel information and to generate a vessel tracking parameter on the vessel;

a vessel tracking processor configured to request the vessel tracking parameter on the vessel from the vessel information database system, and to track the vessel according to a tracking algorithm corresponding to the vessel tracking parameter by using the AIS message or a radar signal for providing position information on the vessel;

a multi-sensor fusing processor configured to calculate a position and a speed of the vessel by using the first vessel information and the second vessel information, or the position information;

a decision making supporting processor configured to calculate a degree of collision danger with another vessel by using the position and speed of the vessel calculated from the multi-sensor fusing processor; and a monitoring display device configured to display a movement of the vessel and the degree of collision danger on a basis of the position and speed of the vessel.

13. The vessel monitoring system of claim 12, wherein the monitoring display device displays the position information on the vessel and characteristic information on a current situation by using tracking information from the vessel tracking processor, the position information from the multi-sensor fusing processor, or information received from at least one of a closed circuit television (CCTV), a satellite, or an unmanned aerial vehicle (UAV).

* * * * *